US008066281B2

(12) United States Patent
Kawabata

(10) Patent No.: US 8,066,281 B2
(45) Date of Patent: Nov. 29, 2011

(54) SHEET TIP CONTACTING BELT CONVEYING APPARATUS AND IMAGE FORMING APPARATUS

(75) Inventor: Kenichi Kawabata, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 894 days.

(21) Appl. No.: 11/503,346

(22) Filed: Aug. 10, 2006

(65) Prior Publication Data

US 2007/0035083 A1 Feb. 15, 2007

(30) Foreign Application Priority Data

Aug. 11, 2005 (JP) ..... 2005-232940

(51) Int. Cl.
*B65H 5/12* (2006.01)
*B65H 9/04* (2006.01)
*B65H 29/30* (2006.01)

(52) U.S. Cl. ..... 271/266; 271/256; 271/193

(58) Field of Classification Search ..... 271/256, 271/266, 275, 193
See application file for complete search history.

(56) References Cited

U.S. PATENT DOCUMENTS

| | | | | |
|---|---|---|---|---|
| 5,280,308 | A * | 1/1994 | Takahashi et al. | 346/134 |
| 5,369,424 | A * | 11/1994 | Hori et al. | 346/134 |
| 7,216,968 | B2 * | 5/2007 | Smith et al. | 347/102 |
| 7,334,858 | B2 * | 2/2008 | Kogure et al. | 347/16 |
| 7,396,123 | B2 * | 7/2008 | Sootome et al. | 347/104 |
| 7,549,635 | B2 * | 6/2009 | Nakashima | 271/275 |
| 7,559,642 | B2 * | 7/2009 | Shigemura | 347/104 |
| 2004/0201168 | A1 * | 10/2004 | Greive | 271/275 |
| 2005/0146554 | A1 | 7/2005 | Asanuma et al. | |
| 2005/0194730 | A1 * | 9/2005 | Nishida et al. | 271/10.01 |
| 2006/0119029 | A1 * | 6/2006 | Kitamura | 271/275 |
| 2006/0153607 | A1 * | 7/2006 | Mori | 399/361 |
| 2008/0001347 | A1 * | 1/2008 | Krause et al. | 271/193 |

FOREIGN PATENT DOCUMENTS

| | | |
|---|---|---|
| JP | 62-299371 | 12/1987 |
| JP | 2000-246981 | 9/2000 |
| JP | 2004-175494 | 6/2004 |
| JP | 2005-15141 | 1/2005 |

OTHER PUBLICATIONS

Aug. 26, 2009 Japanese official action in connection with a counterpart Japanese patent application No. 2005-232940.

* cited by examiner

*Primary Examiner* — Kaitlin Joerger
*Assistant Examiner* — Patrick Cicchino
(74) *Attorney, Agent, or Firm* — Cooper & Dunham LLP

(57) ABSTRACT

An image forming apparatus includes a sheet feeding device that feeds a sheet, and a conveyance belt that conveys the sheet toward a printing region while attracting the sheet with electrostatic force. The printing region is disposed in a vicinity of the conveyance belt. A printing device is provided in the printing region to form an image on the sheet. A controller is provided to control the conveyance belt to stop conveying the sheet toward the printing region for a prescribed period after the tip of the sheet arrives at the conveyance belt and raised from the conveyance belt unit the tip of the sheet settles to the surface of the conveyance belt.

8 Claims, 13 Drawing Sheets

SHEET TIP CONTACTING BELT CONVEYING APPARATUS AND IMAGE FORMING APPARATUS

BACKGROUND

The present disclosure relates to image forming apparatuses and sheet conveyance apparatuses, and in particular, to those capable of electrostatically attracting and conveying a sheet using a conveyance belt.

An inkjet printing system is well known as employed in an image forming apparatus, such as a printer, a facsimile, a copier, a multiple function machine, to form an image by printing, duplicating, and imaging while adhering liquid drop to a sheet.

Specifically, a printer head having a liquid ejecting head in an inkjet printing system ejects a liquid drop during conveyance of the sheet made of various materials.

When an image is formed by such an ink jet printing system, a sheet sometimes expands and creates cockling due to moisture of the ink adhered to the sheet. The cockling causes waves in the sheet, and accordingly a positional relation between the printer head (i.e., a nozzle) and the surface of the sheet varies depending on a portion of the sheet. When the cockling reaches a worst case, the sheet can contact and stain the nozzle, and the head also stains the sheet, and therefore quality of the image deteriorates. Further, due to the cockling, a spotting position of the ink drop is displaced.

In order to maintain a sheet with an excellent flat surface, a seamless discharge belt is provided in an ink jet printing apparatus as discussed in Japanese Patent Application Laid Open No 2004-175494. Specifically, a charge belt electrostatically attracts a sheet, rotates the sheet, and conveys the sheet while preventing displacement of the sheet from the discharge belt.

Japanese Patent Application Publication No 2000-246981 discloses a copy apparatus that executes imaging on an imaging sheet while electrostatically attracting the imaging sheet by means of an electrostatic member at an imaging position to avoid occurrence of cockling and curling of the imaging sheet. The sheet conveying apparatus includes a switching device that switches from a mode in which an imaging sheet is attracted by the electrostatic attraction member to a mode in which an imaging sheet is not attracted by the electrostatic attraction member, vice versa, in accordance with a type of an imaging sheet.

However, an improved technique for avoiding cockling and curling of the imaging sheet is needed.

SUMMARY OF THE DISCLOSURE

The present disclosure provides a novel image forming apparatus configured to avoid the above noted and other problems.

Such a novel image forming apparatus includes a sheet feeding device that feeds a sheet; a conveyance belt that conveys the sheet fed from the sheet feeding device toward a printing region while attracting the sheet with electrostatic force. The printing region is disposed in the vicinity of the conveyance belt. A printing device is provided in the printing region and forms an image on the sheet. A controller is provided to control the conveyance belt to stop conveying the sheet toward the printing region for a prescribed time period until the tip of the sheet arrived and rising from the conveyance belt approaches the surface of the conveyance belt.

In another embodiment, the conveyance belt stops conveying when the tip of the sheet enters a region where the electrostatic force causes attraction to the conveyance belt.

In yet another embodiment, an inlet pressure applying roller is provided opposing a roller suspending the conveyance belt to pressure contact the sheet on the conveyance belt. The conveyance belt stops conveying when the tip of the sheet is pinched by the inlet pressure applying roller and the conveyance belt.

In yet another embodiment, a discharge device is provided to discharge the conveyance belt to create the electrostatic force. An amount of voltage applied to the discharge device is determined in accordance with a type of the sheet.

In yet another embodiment, environment temperature and humidity are detected and the controller determines if and how long the conveyance belt is to be stopped before conveying the sheet to the printing region in accordance with the detection result.

In yet another embodiment, the controller determines if and how long the conveyance belt is to be stopped before conveying the sheet to the printing region in accordance with a type of the sheet.

In yet another embodiment, a registration roller is provided to execute registration of the sheet. A guide member is arranged between the conveyance belt and the registration roller to guide the sheet toward the conveyance belt. The guide member pressure contacts the tip of the sheet when the conveyance belt stops conveying.

In yet another embodiment, a sheet feeding device is provided to feed a sheet. A sheet conveying path extends from the sheet feeding device to the conveyance belt. The path forms a shape that causes the tip of the sheet to be separated from the conveyance belt when the sheet arrives at the conveyance belt. A time period when a plurality of sheets stop on the sheet conveying path is substantially the same when these sheets are successively fed.

In yet another embodiment, a sheet conveying apparatus includes a sheet conveyance belt that circulates in a prescribed orbit while attracting a sheet with electrostatic force, and a controller that controls the conveyance belt to stop conveying the sheet until the tip of the sheet approaches the surface of the conveyance belt when the conveyance belt starts conveying the sheet.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
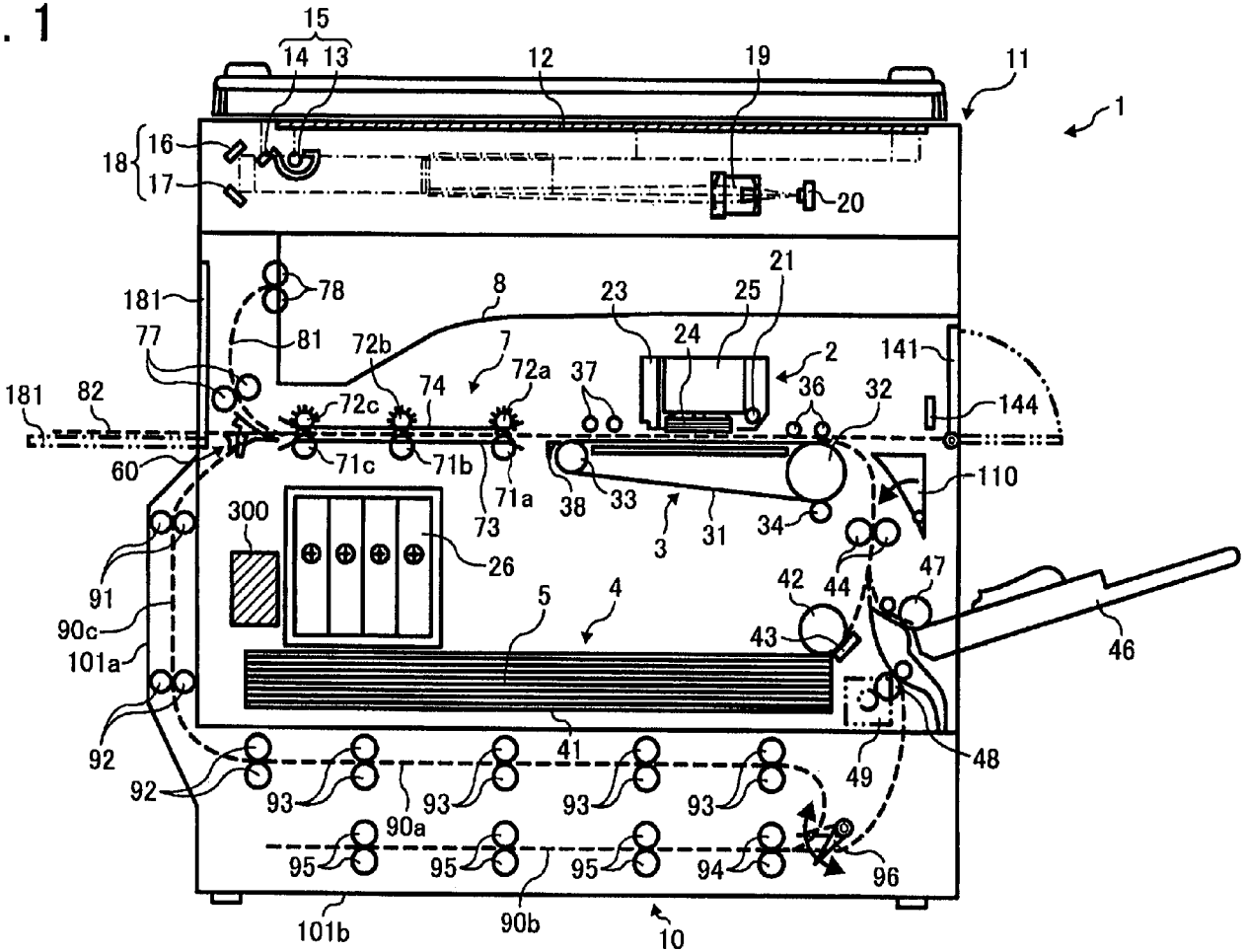
FIG. 1 illustrates a side view of an image forming apparatus according to an exemplary embodiment of the present disclosure.

Referring now to the drawings, wherein like reference numerals and marks designate identical or corresponding parts throughout several figures, in particular, in FIGS. 1 to 5, an exemplary image forming apparatus including a sheet conveyance device according to one embodiment of the present disclosure is described.

The image forming apparatus 1 includes an image forming section 2 that forms an image while conveying a sheet, and a sub scanning direction conveyance section 3 that conveys the sheet and the like. A plurality of sheets 5 are fed one by one from a sheet feeding section 4 disposed at a bottom of the image forming apparatus 1. When a sub scanning direction conveyance section 3 conveys the sheet 5 through a position opposing the image forming section 2, the image forming section 2 forms a desired image on the sheet 5 by ejecting one or more liquid drops.

When simplex printing is executed, the sheet 5 is ejected onto an ejection tray 8 disposed on the upper surface of the image forming apparatus 1 through a sheet ejection conveyance section 7. When duplex printing is executed, the sheet 5 is transferred to a duplex unit 10 provided at the bottom of the image forming apparatus 1 from halfway of the sheet ejection conveyance section 7. The sheet 5 is then switched back and fed to the sub scanning direction conveyance device 3. Thus, a duplex image is formed on the sheet 5 and is ejected onto the ejection tray 8.

Further, the image forming apparatus includes an image reading section 11 (e.g. a scanner section) above the sheet ejection tray 8 to read an image to serve as a system for inputting image data (printing data) so that the image forming section 2 forms an image. The image reading section 11 includes a scanning optical system 15 having an emission light source 13 and a mirror 14, a scanning optical system 18 having a plurality of mirrors 16 and 17 to move and read an image on an original document set onto a contact glass 12. The original document image thus scanned is read by an image reading element 20 as an image signal, and is digitized and processed. Thus, printing data receives image processing and is printed.

Further, the image forming apparatus can receive and print out printing data or the like having image data transmitted from an input system, such as an information processing apparatus like an external personal computer, an image reading apparatus like an image scanner, an imaging apparatus like a digital camera, etc. The input system is disposed on a host side to input image data through a network or a cable so that the image forming section 2 forms an image.

Figure 2:
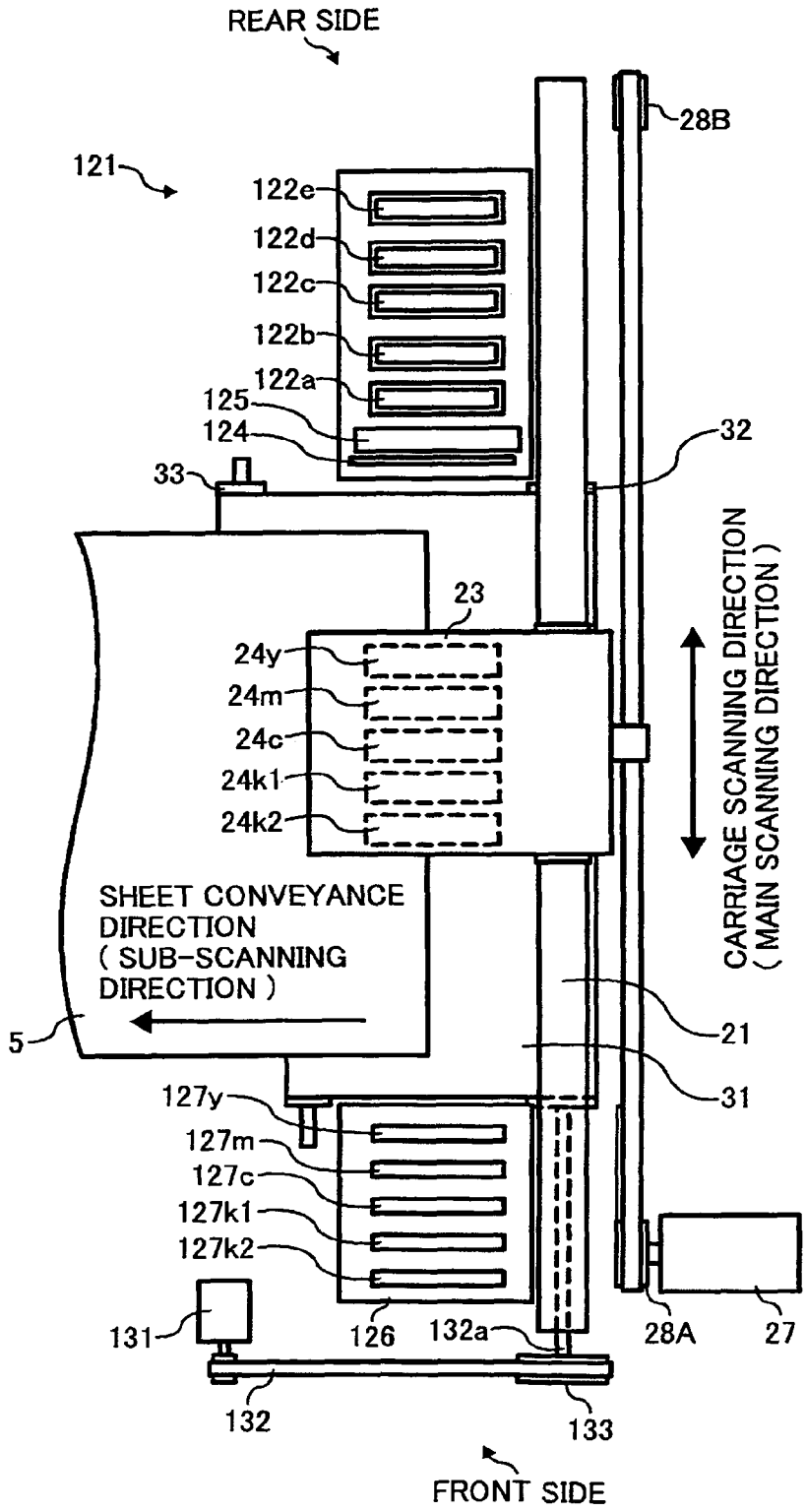
FIG. 2 illustrates a plan view of an example of an image forming section and sub scanning direction conveyance section of the image forming apparatus illustrated in FIG. 1.

As shown in FIG. 2, the image forming section 2 holds a carriage 23 with a guide rod 21 and a guide rail 22 in a cantilever state (see FIG. 5) and moves it in a main scanning direction to execute scanning while driving a main scanning motor 27 that rotates a timing belt wound around driving and driven pulleys 28A and 28B.

A shuttle type is used for image formation. Specifically, a printing head 24 having a plurality of liquid drop ejection heads is mounted on the carriage 23 to eject liquid drops of respective colors. The carriage 23 is moved in the main scanning direction. Image formation is executed by ejecting liquid drops from the printing head 24 while the sub scanning direction conveyance section 3 feeds the sheet 5 in a sheet conveyance direction (i.e., the sub scanning direction). However, a line type head can alternatively be employed.

The printing head 24 includes five liquid drop ejection heads (hereinafter sometimes collectively referred to as a printing head 24). Specifically, a pair of liquid drop ejecting heads 24*k*1 and 24*k*2 that eject black (Bk) ink, and a plurality of liquid drop ejecting heads 24*c*, 24*m*, and 24*y* that eject cyan (C) ink, magenta (M) ink, and yellow (Y), respectively, are provided. A plurality of sub tanks 25 are mounted on the carriage 23 and supply respective inks to the liquid drop ejecting heads.

As shown in FIG. 1, color ink cartridges 26 storing black, cyan, magenta, and yellow (Bk, C, M, and Y) inks, respectively, are detachably attached from a front cover to a cartridge attachment section in the image forming apparatus 1, so as to supply the sub tanks 25 with the respective inks. The black ink is supplied to two sub tanks 25 from a single ink cartridge 26.

As a printing head 24, a piezoelectric type is used such that a piezoelectric element as a pressure generation device (i.e., an actuator device) applies pressure to ink in an ink path of flow (a pressure generation room) and deforms a vibration plate that forms a wall of the ink path. Otherwise, a thermal type is used such that an ink drop is ejected by pressure created by air bubble, which is generated by heating the ink in the ink path of flow using a heat generation resistance member.

Still otherwise, an electrostatic type that includes a vibration plate and an electrode collectively forming a wall of an ink path of flow can be employed. Specifically, the electrostatic type ejects liquid drop by deforming the vibration plate by means of electrostatic force generated between the vibration plate and the electrode.

Further, as shown in FIG. 2, a maintenance-recovery apparatus 121 is arranged in a non-printing region on one side of the carriage 23 in the main scanning direction to maintain and recover a condition of the nozzles of the printing head 24. The maintenance-recovery apparatus 121 includes five moisture maintaining caps 122*k*2, 122*k*1, 122*c*, 122*m*, and 122*y* (herein after sometimes collectively referred to as a moisture maintaining cap) that cap respective nozzle surfaces of the five printing heads 24, an absorption cap 123, a wiper blade 124 that wipes the nozzle surfaces, and a trial ejection receiving member 125 used when liquid drop not contributing to printing (i.e., image formation) is ejected.

Further, as shown in FIG. 2, in a non printing region on the other side of the carriage 23 in the main scanning direction, a trial ejection receiving member 126 is provided to be used when liquid drop not contributing to printing is ejected from the five printing heads 24. Five openings 127*k*2, 127*k*1, 127*c*, 127*m*, and 127*y* (hereinafter sometimes collectively referred to as an opening 127) are formed in accordance with the printing heads 24 in the trial ejection receiving member 126.

Figure 3:
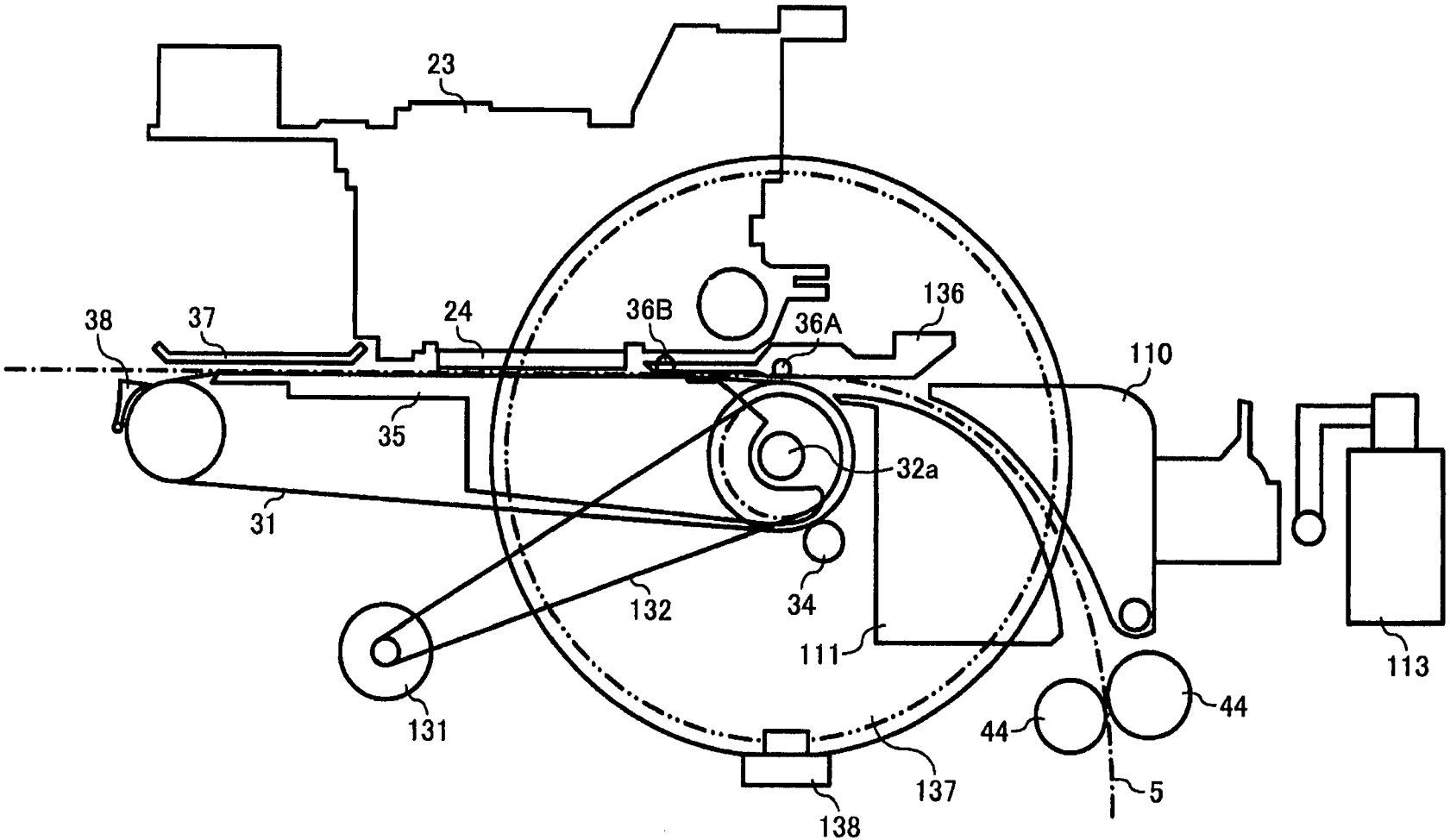
FIG. 3 illustrates a side view of a portion of the conveyance path near the image forming section and the sub scanning direction conveyance section illustrated in FIG. 2.

As shown in FIG. 3, the sub scanning direction conveyance section 3 includes an endless conveyance belt 31 wound around a conveyance roller 32 serving as a driving roller and a tension roller 33 serving as a driven roller. The endless conveyance belt 31 of the sub scanning direction conveyance section 3 changes a direction of a sheet 5 fed from beneath the conveyance belt 31 by an angle of about 90 degree and conveys the sheet 5 to a position opposing the image forming section 2. Also included in the sub scanning direction conveyance section 3 are a discharge roller 34 to discharge the surface of the conveyance belt 31 as a discharge device, while receiving a high alternation voltage from a high voltage source; a guide member 35 (FIG. 3) that guides the conveyance belt 31 at a region opposing the image forming section 2; a pressure applying roller 36A rotatably supported by a supporting member 136 to depress the sheet 5 toward the conveyance belt 31 at a position opposing the conveyance roller 32; a tip pressure applying roller 36B that depresses the sheet 5 toward the conveyance belt 31 at a position upstream of the printing head 24; a guide plate 37 that depresses the upper surface of the sheet 5 carrying an image formed by the image forming section 2; and a separation pick 38 that separates the sheet 5 from the conveyance belt 31.

The conveyance belt 31 circulates in the sheet conveyance direction when a conveyance roller 32 is rotated by a sub scanning motor 131, such as a DC non-brush motor, via a timing belt 132 and a timing roller 133. The conveyance belt 31 is formed from pure resin material not receiving resistance control, for example. Specifically, the conveyance belt 31 is formed from two layers of a front layer including ETFT pure material as a sheet absorption surface and a rear layer (e.g. a middle resistance layer, an earth layer) having the same material as the front layer and receive the resistance control by means of carbon. However, the conveyance belt 31 is not limited to the above, and can include a single layer or more than triple layers.

Further, even not shown, a cleaning device (e.g. a mylar sheet) that removes sheet dust or the like adhered to the surface of the conveyance belt 31, and a charge removing brush that removes charge remaining on the surface are provided between the driven roller 33 and the discharge roller 34.

Further, a high resolution code wheel 137 is attached to a shaft 32*a* of a conveyance roller 32. An encoder 138 including a transmission type photo-sensor is provided to detect a slit 137*a* formed on the code wheel 137. Thereby, a rotary encoder is formed from the code wheel 137 and the encoder sensor 138.

A sheet feeding section 4 is detached from the image forming apparatus 1 at the front side. The sheet feeding section 4 includes a sheet feeding member 41 storing a plurality of sheets 5, a sheet feeding roller 42 and a friction pad 43 for separating and feeding sheets 5 stored in the sheet feeding member 41 one by one, and a pair of registration rollers 44 for executing registration of the sheet 5.

The sheet feeding section 4 further includes a multiple manual sheet feeding tray 46 for stacking a plurality of sheets 5, a manual sheet feeding roller 47 for separating and feeding the sheets one by one from the multiple manual sheet feeding tray 46, and a vertical conveyance roller 48 for conveying sheets 5 fed from an optionally attached sheet feeding section or a duplex unit 10 attached to the lower portion in the image forming apparatus 1. The sheet feeding roller 42, registration roller 44, manual sheet feeding roller 47, and vertical conveyance roller 48 are provided to feed the sheet 5 to the sub scanning direction conveyance section 3, and are each driven by a sheet feeding motor 49 such as a HB type stepping motor via an electromagnetic clutch, not shown.

A sheet ejection conveyance section 7 includes three conveyance rollers 71*a*, 71*b*, and 71*c* (hereinafter sometimes collectively referred to as a conveyance roller 71), three spurs 72*a*, 72*b*, and 72*c* (hereinafter sometimes collectively referred to as a spur 72), and both lower and upper guide sections 73 and 74 for guiding a sheet conveyed between the conveyance roller 71 and the spur 72. Also included are a pair of reverse rollers 77 and a pair of reverse ejection rollers 78 for reversing the sheet 5 launched from between the lower and upper guide sections 73 and 74 along a reverse sheet ejection path 81 serving as the first conveyance path while transferring the sheet 5 with its front surface facing down to an sheet ejection tray 8. 70 denotes a conveyance path that conveys a sheet 5 between the lower and upper guide sections 73 and 74.

On an exit side of the conveyance path 70, a branching mechanism 60 is provided to selectively cause the conveyance path to branch off into one of the first sheet ejection path 81 for reversing and ejecting a sheet onto the sheet ejection tray 8, the second sheet ejection path 82 for ejecting a sheet onto a straight sheet ejection tray 181, and a conveyance path extending toward the duplex unit 10.

The duplex unit 10 integrally includes a vertical conveyance section 101*a* that receives a sheet 5 from one side of the image forming apparatus 1 and downwardly conveys it along a vertical duplex conveyance path 90*c*. Also included are a horizontal conveyance section 101*b* that forms a horizontal path 90*a*, which horizontally conveys the sheet 5 following the vertical duplex conveyance path 90*c*, and a switch back conveyance path 90*b*.

The vertical duplex conveyance path 90*c* includes a pair of conveyance rollers 92 for transferring the sheet 5 toward either a pair of duplex inlet rollers 91 or to be downwardly conveyed or to the horizontal path 90*a*. The horizontal path 90*a* includes five pair of duplex conveyance rollers 93. The switch back conveyance path 90*b* includes a duplex outlet roller 94 including a reverse roller for reversing and re-feeding a sheet 5 conveyed from the horizontal conveyance path 90*a*, and three pair of duplex conveyance rollers 95.

Further, a branching off plate 96 is swingably mounted to switch from a sheet feeding path extending from the horizontal conveyance path 90*a* to the switch back path 92*b* to a sheet re-feeding path extending from the switch back conveyance path 90*b* to the pair of conveyance rollers 48 vice versa. The branching plate 96 is swingable between the switch backside position shown by a solid line and a sheet re-feeding side position shown by a dotted line as shown in FIG. 1.

The sheet 5 launched from the duplex unit 10 is transferred toward the above-mentioned conveyance roller 48 and the registration roller 44.

To avoid application of back tension to the sheet 5 by forming a loop (i.e., slack) on the sheet between the conveyance roller 32 (or the depressing roller 36) and the registration roller 44 when the sheet 5 is conveyed to the registration roller 44 from one of the above-mentioned sheet feeding section 41, the manual sheet feeding tray 46 and the duplex unit 10, an open/close guide plate 110 is swingably mounted opposing the guide section 111 as shown in FIGS. 1 and 3. Further, an open/close guide plate solenoid 113 is arranged to swing the open/close guide plate 110.

Specifically, the open/close guide plate 110 swings toward the guide section 111 as illustrated in FIG. 1 to guide the sheet 5 when the registration roller 44 launches the sheet 5 toward the sub scanning direction conveyance section 3. The open/close guide plate 110 returns to an original position as shown to allow the sheet 5 to form a loop when the sheet 5 reaches the sub scanning direction conveyance section 3.

Further, as shown in FIG. 1, to execute singular sheet manual feeding in the image forming apparatus, a singular manual sheet feeding tray 141 is openably attached to one side of the image forming apparatus 1. The tray 141 tilts and is open to take a position as shown by a virtual line when the singular sheet manual feeding is executed. Accordingly, a sheet 5 manually fed from the singular sheet manual feeding tray 141 can be guided by the upper surface of the openable guide plate, and is inserted straight forward, as is, to a gap between a cover 32 and the pressure applying roller 36A in the sub scanning direction conveyance section 3.

On the other hand, to linearly eject the sheet 5 with its image side facing up, a straight sheet ejection tray 181 is openably attached to the other side of the image forming apparatus 1. By opening the straight sheet ejection tray 181, a straight sheet ejection path 82 is formed as the second sheet ejection path that linearly ejects the sheet 5 fed from the upper and lower guide sections 73 and 74 onto the straight sheet ejection tray 181.

Thus, when a sheet which would be difficult to convey over a curved path (such as an OHP, a thick sheet, etc.) is utilized, single sheet manual feeding is executed from the single sheet manual feeding tray 141, and is linearly conveyed to the straight sheet ejection tray 181. Of course, the same advantage can be obtained when an ordinary sheet such as a plain paper is used.

Figure 4:
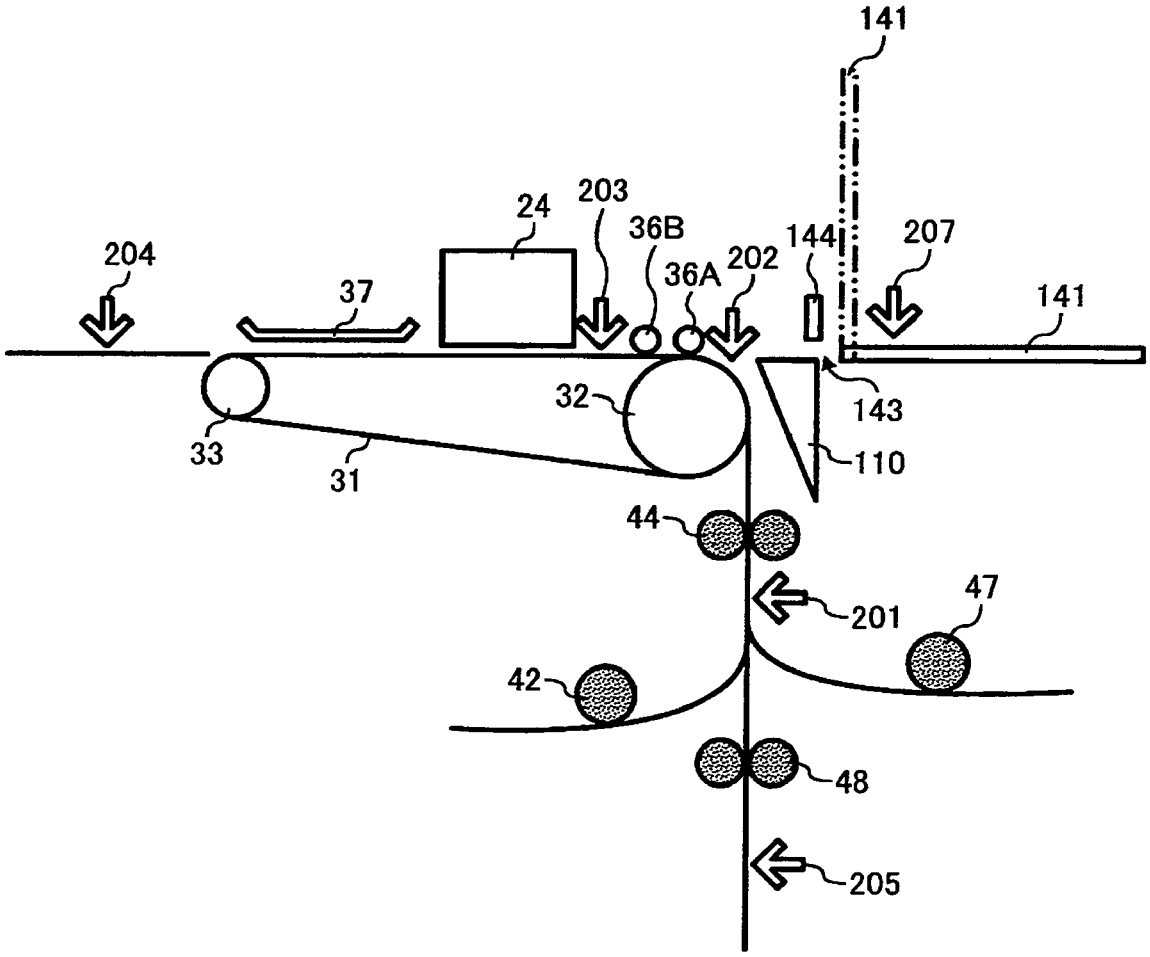
FIG. 4 illustrates an exemplary sheet conveyance path extending toward a conveyance belt, according to an exemplary embodiment of the present disclosure.

Now, with reference to FIG. 4, various sensors arranged upstream of the image forming section 2 is described. To detect the sheet 5, a conveyance registration sensor 201 is arranged upstream of the registration roller 44. A printing region inlet sensor 202 is arranged upstream of the conveyance roller 32 and the pressure applying roller 36A. An image registration sensor 203 is arranged downstream of a leading end pressure applying roller 36B (i.e., an inlet of an image forming section 2) to execute registration of a position from which image writing starts. An electromagnetic crutch open sensor 205 is arranged upstream of the vertical conveyance roller 48. A manually feed sheet presence absence detecting sensor 207 is arranged to determine if the sheet 5 is set onto the manual sheet feeding tray 141.

Figure 5:
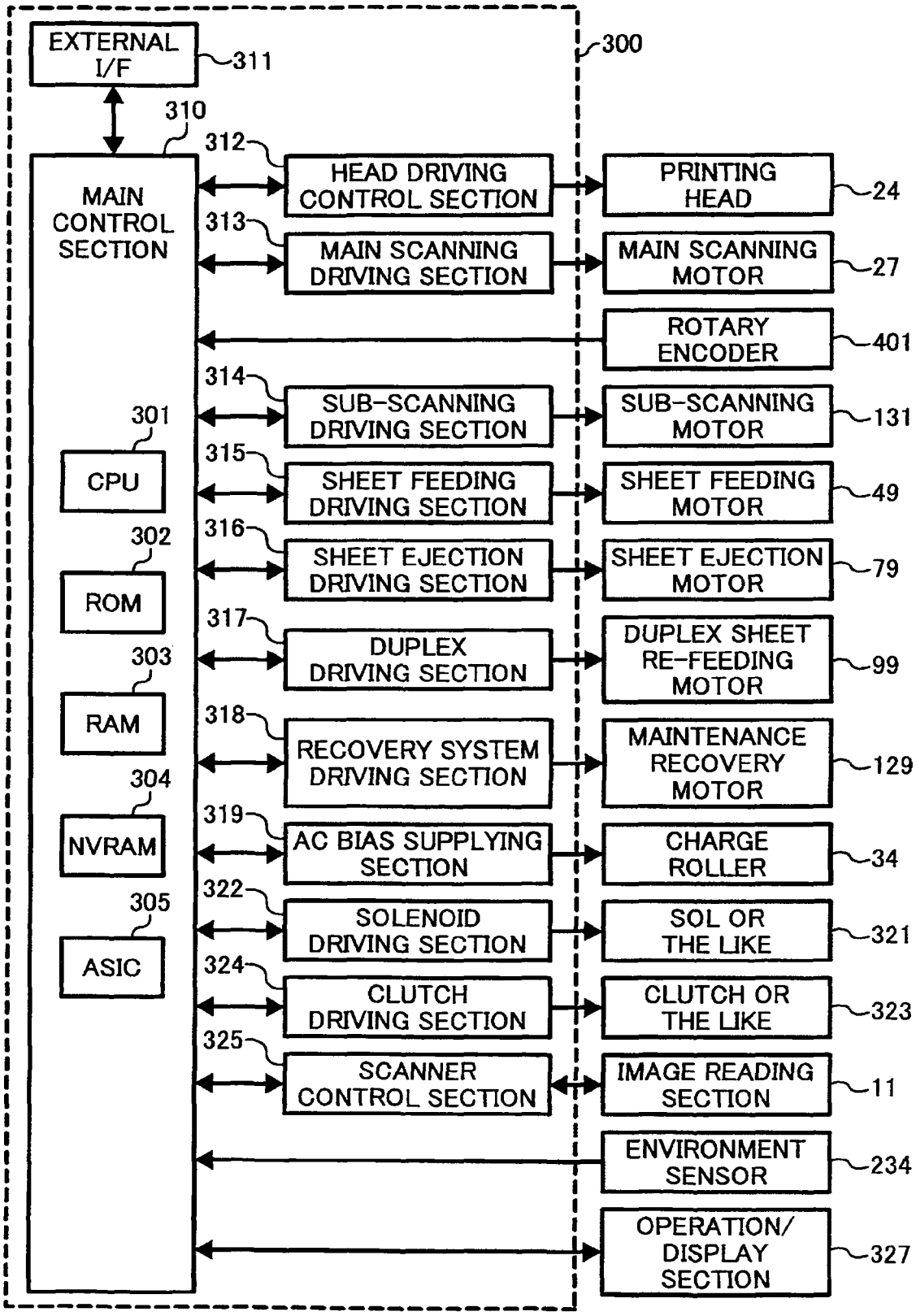
FIG. 5 illustrates a block diagram of an exemplary control section according to an exemplary embodiment of the present disclosure.

Now, a control section of the image forming apparatus is described with reference to FIG. 5. The control section 300 includes a CPU 301, a ROM 302 that stores program executed by the CPU and other static data, a RAM 303 that temporarily stores image data or the like, a non-volatile memory 304 that stores data when power supply of the image forming apparatus is turned off, and a main control section 310 that controls the entire apparatus. The main control section 310 includes an ASIC 305 that executes image processing, such as processing of various signals of image data, sorting, etc. The ASIC processes input and output signals for controlling the entire apparatus.

The control section 300 intervenes between a host and the main control section 310. The control section 300 includes an external I/F 311 that executes communications of data and signals, a head drive control section 312 including a head driver that drives and controls a plurality of printing heads 24, and a main scan drive section (e.g. a motor driver) 313 that drives a main scanning motor 27 to move and scan a carriage 23. Also included are a sub scanning drive section 314 that drives a sub scanning motor 131, a sheet feed drive section 315 that drives a sheet feed motor 49 and a sheet ejection drive section 316 that drives a sheet ejection motor 79 that drives each of rollers arranged in the sheet ejection section 7. Also included are a duplex driving section 317 that drives a duplex sheet re-feeding motor 99 that drives each of rollers arranged in the duplex unit 10, a recovery driving section 318 that drives a maintenance-recovery motor 129 that drives a maintenance-recovery mechanism 121, and an AC bias supplying section 319 that supplies an AC bias to the discharge belt 34.

The control section 300 includes a solenoid drive section (i.e., a driver) 322 that drives various solenoids including an open/close guide plate solenoid 113 and a shutter solenoid 150, a clutch drive section 324 that drives an electromagnetic clutch 323 for sheet feeding, and a scanner control section 325 that controls an image reading section 11.

The main control section 310 receives an input of a detection signal from an environment sensor 234 that detects ambient temperature and humidity near the conveyance belt 31. Detection signals (not shown) of various sensors are input to the main control section 310. The main control section 310 takes in a necessary key input and outputs display information from and to various keys arranged in the image forming apparatus 1, such as ten pad keys, a print start key, etc., and an operation/display section 327 including various displays.

Further input to the main control section 310 is an output signal in a pulse state from a rotary encoder 402 including the above-mentioned code wheel 137 and the photo-sensor (e.g. an encoder sensor) 138. The main control section 310 controls driving of the sub scanning motor 131 via a sub scanning drive section 314 based on the output signal and moves the conveyance belt 31 via the conveyance roller 32.

An operation of the image forming apparatus having the above-mentioned configuration is now described. A high alternate voltage having a rectangular wave is applied to the discharge roller 34 from the AC bias supplying section 319. Since the discharge roller 34 contacts an insulation layer (a surface layer) of the conveyance belt 31, positive and negative electric charges are created one after another on the conveyance belt 31 in a conveyance belt conveyance direction at a prescribed interval of width. Thereby, an electric field is alternatively created.

Then, when the sheet 5 is launched into the conveyance belt 31 between the conveyance roller 32 and the pressure applying roller 36A, in which the alternating electric field is created, from one of the sheet feeding section 4, the manual sheet feeding section 46, the duplex unit 410, the singular manual sheet feeding tray 141 and the like, polarities of the sheet 5 are immediately divided in accordance with the direction of the electric field. Thus, the sheet 5 is attracted to the conveyance belt 31 by an electrostatic attraction force, and is conveyed as the conveyance belt 31 travels.

Then, while the conveyance belt 31 intermittently conveys the sheet 5, the printing head 24 ejects liquid drops and forms an image in accordance with printing data on the sheet 5. The separation pick 38 separates the sheet 5 with the image from the conveyance belt 31. The sheet ejection conveyance section 7 ejects the sheet onto any one the sheet ejection tray 8 and the straight sheet ejection tray 181. Otherwise, the sheet is fed to the duplex unit 10. Then, image formation is executed on the other side of the sheet 5 and is ejected.

Figure 6:
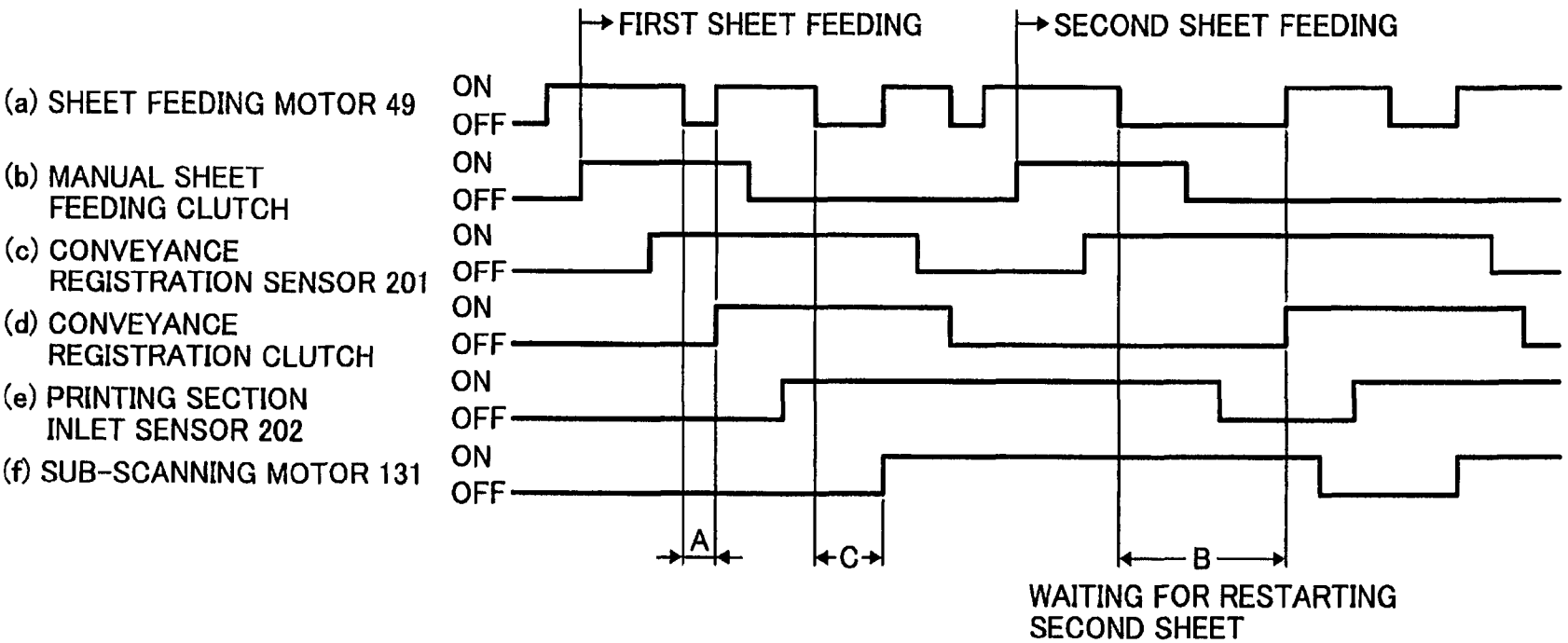
FIG. 6 illustrates a timing chart for an exemplary sequence suitable for the image forming apparatus according to the first exemplary embodiment of the present disclosure.

The first embodiment of the image forming apparatus is now described with reference to FIGS. 6(*a*) through 6(*f*). When the sheet feed motor 49 and the manual sheet feeding clutch are turned on as shown in FIGS. 6A and 6B, the manual sheet feeding roller 47 rotates, separates, and feeds the sheet 5 from the multiple manual sheet feeding tray 46. As shown in FIGS. 6(*a*) and 6(*c*), the sheet feed motor 49 (see, FIG. 1) is turned off when a prescribed time period has elapsed after the conveyance registration sensor 201 detects the sheet 5. As shown in FIGS. 6(*a*) and 6(*d*), a conveyance registration clutch (not shown) and the sheet feed motor 49 are turned on when a prescribed time period A has elapsed thereafter. Then, the sheet 5 starts advancing toward the conveyance belt 31.

As shown in FIG. 6(*e*), when the printing region inlet sensor 202 detects the sheet 5, the sheet feed motor 49 is turned off again, and the sheet 5 thereby stops advancing and remains in a standby state.

When a prescribed time period C has elapsed, the sheet feed motor 49 is turned on and sheet 5 starts advancing. At same time, the sub scanning motor 131 is driven and the conveyance belt 31 starts conveying while attracting the sheet 5 as shown in FIG. 6(*f*).

When printing is continuously executed, the manual sheet feeding clutch is turned on and the second sheet is fed from the manual sheet feeding tray 46 before the printing for the first sheet is completed (for example, when a prescribed time period has elapsed after the conveyance registration sensor 201 detects the trailing edge of the sheet and generates an turn off signal). When a prescribed time period has elapsed after the conveyance registration sensor 201 detects the second sheet, the sheet feed motor 49 is turned off. Thus, the second sheet waits a prescribed time period B at the registration roller 44 before being fed therefrom.

Thus, as illustrated in FIG. 6, after the multiple manual sheet feeding tray 46 manually feeds a sheet 5 and before the conveyance belt 31 electrostatically attracts and starts conveying the sheet 5, the conveyance belt 31 conveys the sheet 5 after a prescribed time period C has elapsed after the sheet 5 is fed to the conveyance belt 31. The prescribed time period C preferably corresponds to a time from when the sheet 5 arrived at the conveyance belt 31 to when at least the tip of the sheet settles down (that is, becomes attracted) to the conveyance belt 31. More preferably, the time period corresponds to a time from when the sheet 5 arrives at the conveyance belt 31 to when the sheet is curled with its central portion separating from the conveyance belt 31 and with its tip settled down thereto.

Figure 7:
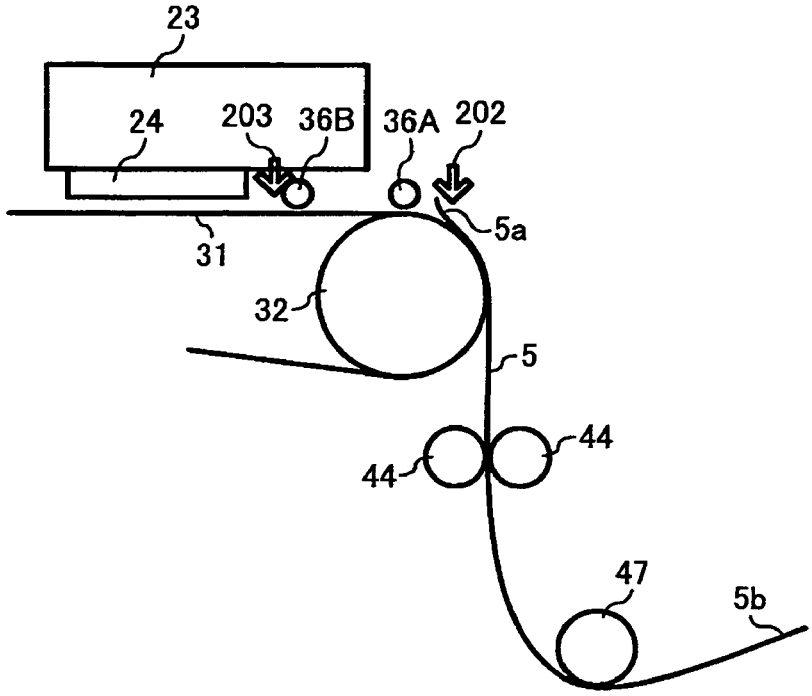
FIG. 7 illustrates schematically a condition of a sheet with its leading section rising from a conveyance belt.

That is, when a sheet 5 is fed from the manual sheet feeding tray 46, the manual sheet feeding roller 47 contacts a front surface of the sheet 5 not contacting the conveyance belt 31. As a result, the tip 5*a* (and the trailing end 5*b*) of the sheet 5 rises from the conveyance belt 31 as enlarged and shown in FIG. 7. As a result, the sheet 5 becomes curled with the central portion contacting the conveyance belt 31 (herein after referred to as a reverse curl state). Especially, when the second sheet is maintained in the reverse curl state during consecutive printing waiting for conveyance of the conveyance belt 31 as shown in FIG. 6B, the reverse curl state becomes unacceptable.

When the sheet 5 is the reverse curl state as mentioned, the tip of the sheet 5 rises from the surface of the conveyance belt 31, and electrostatic attraction force is weak and does not sufficiently attract the sheet to the belt. As a result, the sheet 5 does not closely contact the conveyance belt 31. As a result, when the sheet 5 is fed for printing (i.e., conveyance to a printing region is started), the tip of the sheet 5 contacts and scrapes the nozzle surface of the printing head 24, or an image is scraped by the nozzle. Thereby, high quality image is often not obtained.

Then, according to the image forming apparatus, as mentioned earlier, when the conveyance belt 31 starts electrostatically attracting and conveying the sheet 5 toward the printing region in which the printing device executes printing, the conveyance belt 31 stops conveying the sheet 5 for a time period from when the sheet 5 arrives at the conveyance belt 31 to when the tip of the sheet settles down to the conveyance belt 31. For example, the conveyance start is delayed until when the sheet is forwardly curled such that the center of the sheet 5 rises (is separated) from the conveyance belt 31 while the tip thereof settles down to the conveyance belt 31. In the printing region, the printing device such as a printing head 24 ejects liquid drop and forms an image on a sheet 5.

Thus, the sheet in the reverse curl state changes to be the forward curl state, and the tip of the sheet 5 does not rise from the surface of the conveyance belt 31, and the sheet 5 closely contacts the conveyance belt 31 because of sufficient electrostatic attraction force. As a result, during printing, the tip of the sheet 5 does not scrape the nozzle surface of the printing head 24, and the nozzle does not scrape an image. Thus, sheet conveyance is stable while a high quality image can be formed.

In the timing charts of FIGS. 6(*a*) through 6(*f*) a sheet feeding path from the sheet feeding device (for example, a multiple manual sheet feeding tray 46) for feeding a sheet to the conveyance belt 31 makes the sheet forwardly curled such that the tip of the sheet rises from the conveyance belt and the central portion contacts the conveyance belt 31. However, when sheets are successively fed, the second sheet is fed before the printing for the first sheet is completed (e.g. when the conveyance registration sensor 201 detects the trailing edge of the sheet), and the sheet feed motor 49 is turned off when a prescribed time period has elapsed after the conveyance registration sensor 201 detects the sheet 5. Then, the second sheet waits a prescribed time period B before being fed.

Thus, the second and successive sheets remain in a standby state while being held within the sheet feeding path for the prescribed time period B and maintaining a reverse curl state. Since the reverse curl state is kept for a longer time period B(A<B) than a time period A for the first sheet, the reverse curl is more pronounced.

To avoid such a defect, times when respective sheets 5 stop after being fed from the multiple manual sheet feeding tray and before being fed to the conveyance belt 31 are controlled to be the same. In other words, the waiting time period B for restarting the second sheet is controlled to be the same as the waiting time period A for the first sheet. As a result, a stopping time period creating the reverse curl in each of the respective sheets can be decreased.

Figure 8:
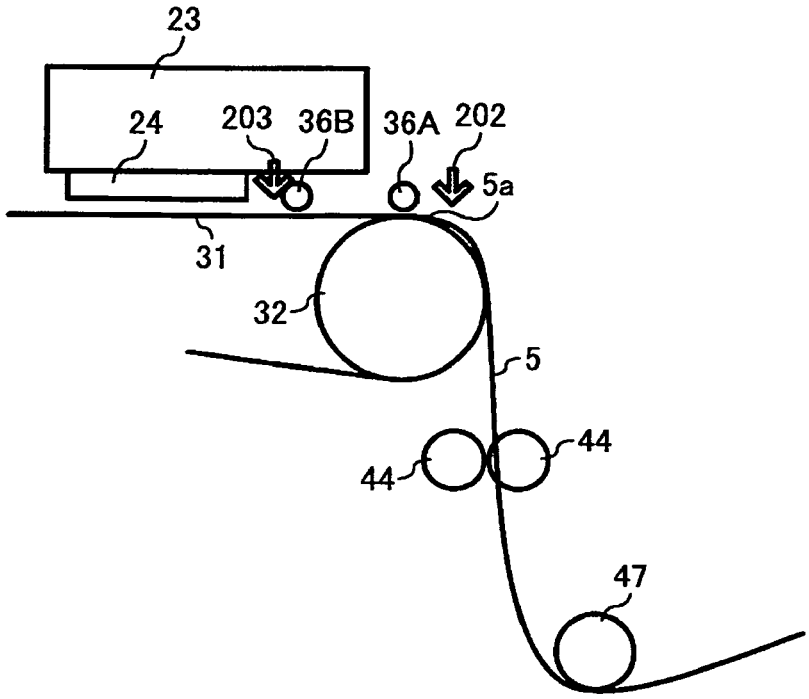
FIG. 8 illustrates a first modification of a stopping position of the sheet leading section according to an exemplary embodiment of the present disclosure.

Now, various modifications of the first embodiment having different stopping positions of the tip of the sheet are described with reference to FIGS. 8 to 11. As shown in FIG. 8 illustrating the first modification, when a printing region inlet sensor 202 detects a tip 5*a* of a sheet 5, the sheet is stopped at a position upstream of the pressure applying roller 36A. The sheet 5 waits a prescribed time period until the tip 5*a* settles to the conveyance belt 31 or the sheet 5 changes to a forward curl state.

Figure 9:
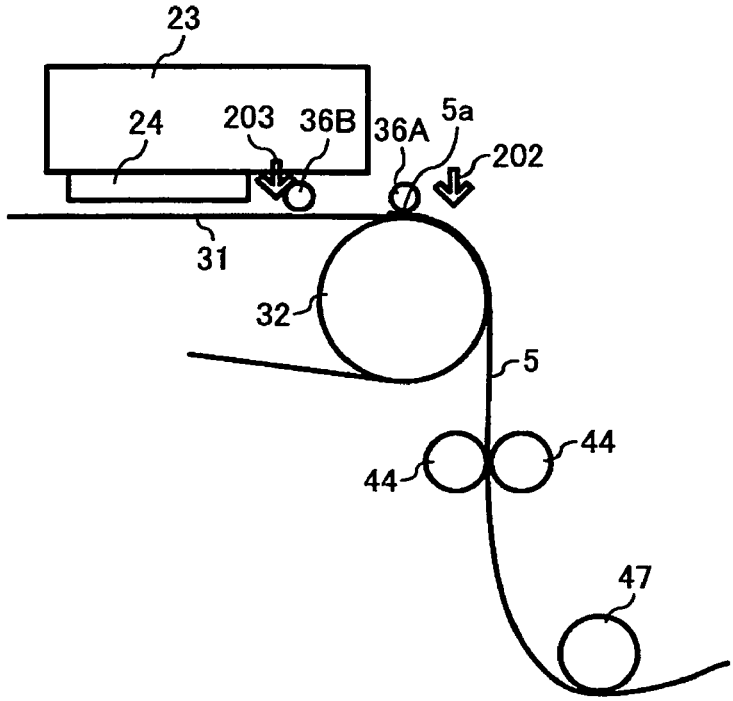
FIG. 9 illustrates a second modification of a stopping position of the sheet leading section according to another exemplary embodiment of the present disclosure.

As shown in FIG. 9 illustrating the second modification, the sheet 5 is conveyed and stopped at a position at which the tip 5*a* of the sheet 5 is pinched by the pressure applying roller 36A and the conveyance belt 31. Then, the sheet 5 maintains a standby state for a prescribed time period until the tip 5*a* settles to the conveyance belt 31 or the sheet 5 changes to a forward curl state. Specifically, the inlet pressure applying roller 36A is provided opposing the conveyance roller 32 (which winds the conveyance belt 31) to depress the sheet 5 toward the conveyance belt 31. Thus, the sheet 5 remains in the standby state while being pinched between the inlet pressure applying roller 36*a* and the conveyance belt 31.

In this situation, the sheet 5 cannot be pinched between the pressure applying roller 36*a* and the conveyance belt 31 if only the registration roller 44 rotates, and therefore the sub scanning motor 131 and thus the conveyance belt 31 are additionally driven until the tip 5*a* is pinched by the pressure applying roller 36*a* and the conveyance belt 31.

Thus, by maintaining such a standby state with the tip 5*a* being pinched between the pressure applying roller 36*a* and the conveyance belt 31, the tip 5*a* more reliably settles to and contacts the conveyance belt 31 or changes to a forward curl state.

Figure 10:
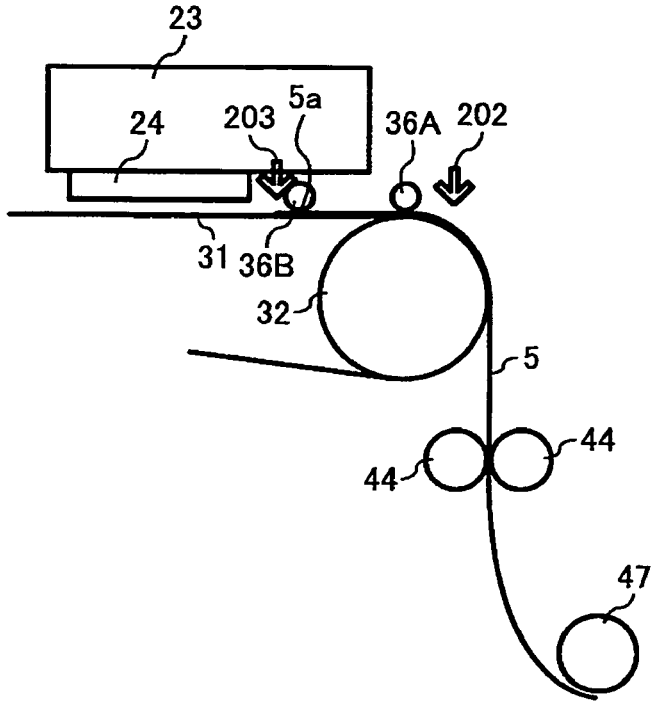
FIG. 10 illustrates a third modification of a stopping position of the sheet leading section according to another exemplary embodiment of the present disclosure.

As shown in FIG. 10 illustrating the third modification, the sheet 5 is conveyed and stopped at a position at which the tip 5*a* is pinched by the tip pressure applying roller 36B and the conveyance belt 31. The sheet 5 maintains a standby state for a prescribed time period until the tip 5*a* settles to the conveyance belt 31 or the sheet 5 changes to the forward curl state. Specifically, the tip pressure applying roller 36B is provided to depress the sheet 5 toward the conveyance belt 31, and the sheet 5 maintains the standby state while being pinched between the tip pressure applying roller 36B and the conveyance belt 31.

The sheet 5 can not be pinched between the tip pressure applying roller 36B and the conveyance belt 31 if only the registration roller 44 rotates, the sub scanning motor 131 and thus the conveyance belt 31 are additionally driven until the tip 5*a* is pinched between the tip pressure applying roller 36B and the conveyance belt 31.

Thus, by maintaining such a standby state while the tip 5*a* is pinched between the tip pressure applying roller 36B and the conveyance belt 31, the tip 5*a* more reliably settles to and contacts the conveyance belt 31 or changes to a forwardly curled state.

Figure 11:
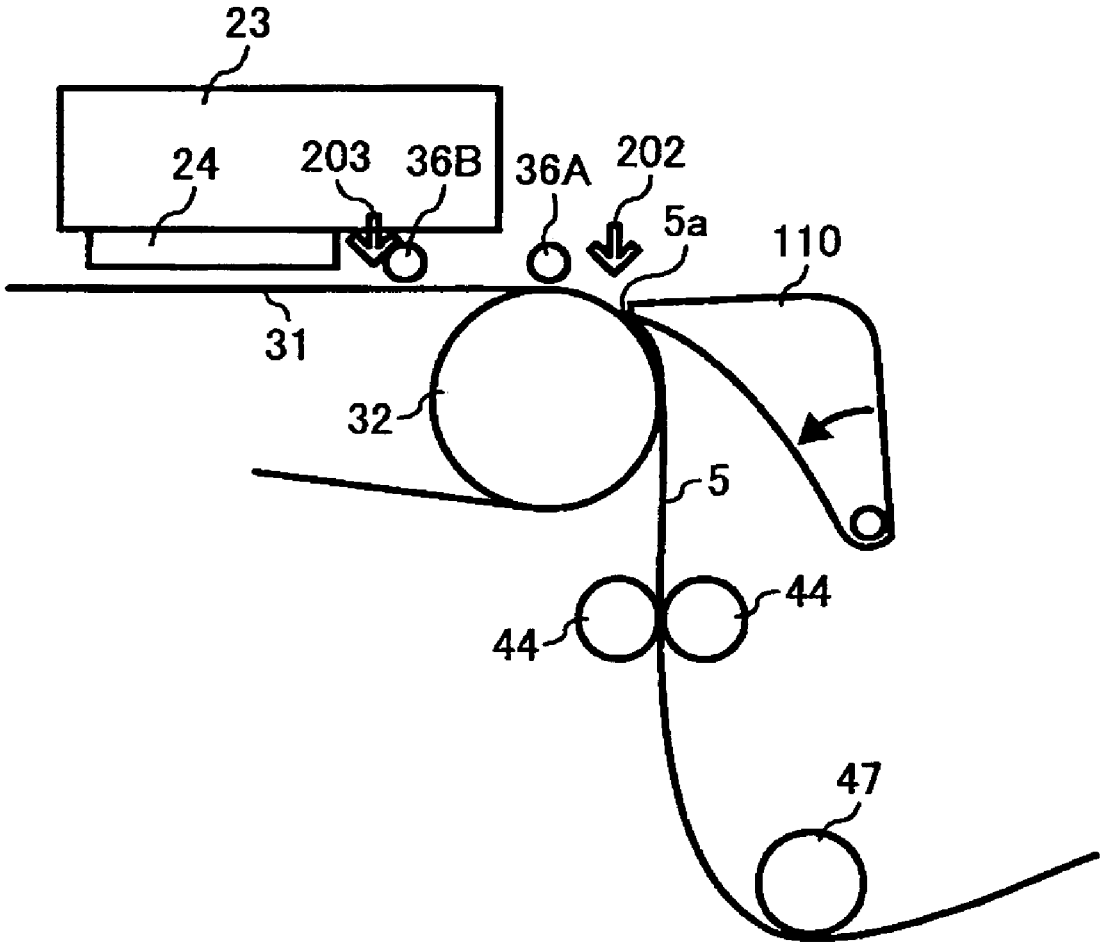
FIG. 11 illustrates a fourth modification of a stopping position of the sheet leading section according to another exemplary embodiment of the present disclosure.

As shown in FIG. 11 illustrating the fourth modification, the open/close guide plate 110 is swung in a direction shown by an arrow on the side of the conveyance belt 31 more upstream than the first modification. The sheet 5 is stopped and maintains a standby state with the tip 5*a* approaching (or being depressed toward) the conveyance belt 31. Thus, when the open/close guide plate 110 depresses the tip 5*a*, the tip 5*a* more reliably settles to the conveyance belt 31 or changes to a forwardly curled state during the standby state than when the tip 5*a* is left free.

The position to stop the sheet 5 is preferably downstream of the discharge roller 34 and within a region where electric charge is applied to the conveyance belt 31. Thus, the sheet with its tip 5*a* approaching the conveyance belt 31 or that having a forward curl state can be attracted electrostatically to the conveyance belt 31 in a reliable manner.

Figure 12:
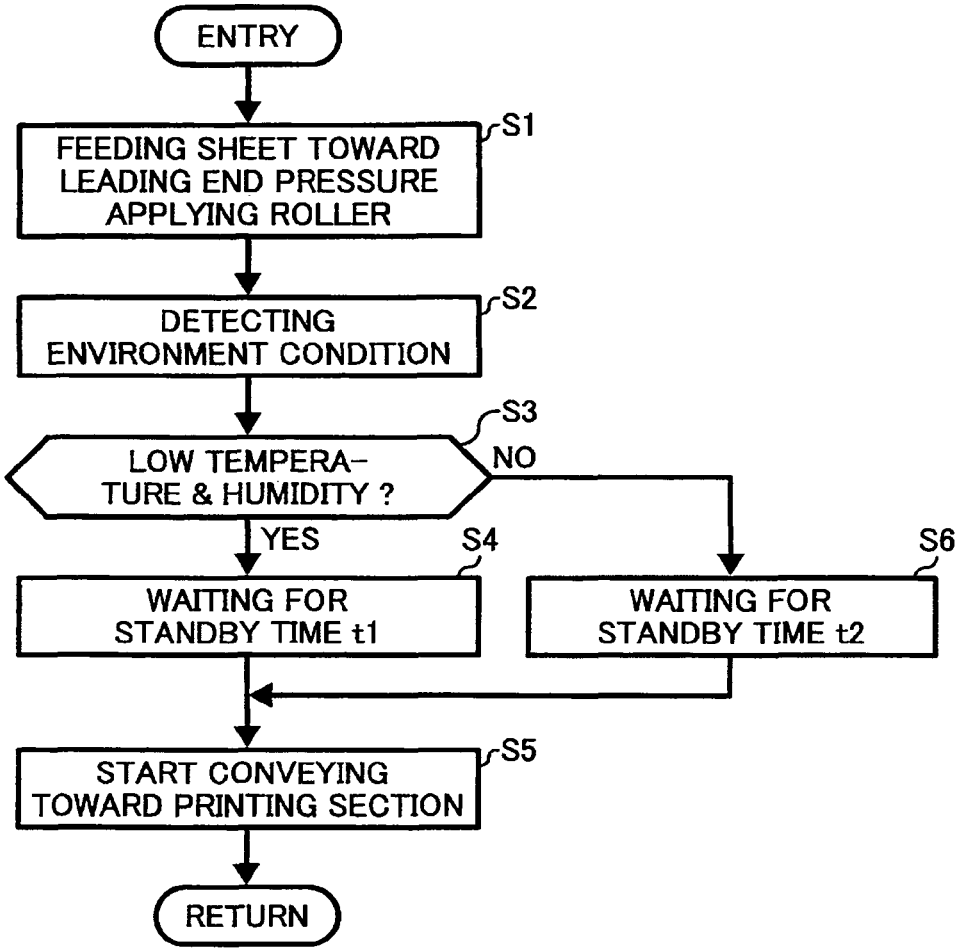
FIG. 12 illustrates another exemplary sequence suitable for the image forming apparatus according to the second embodiment of the present disclosure.

Now, a second embodiment is described with reference to FIG. 12. Sheet feed and conveyance is controlled by a control section 300. As shown, the sheet 5 is fed until the tip 5*a* is pinched between the tip pressure applying roller 36B and the conveyance belt 31. Then, it is determined whether temperature and humidity are low based on detection of an environment sensor 234 disposed either in a sheet feeding cassette or inside the conveyance belt 31. If the determination is positive (i.e., low), the sheet 5 is stopped for a standby time period t1. The sheet 5 is fed again to the printing region after the expiration of the time period t1. If the determination is negative (i.e., not low), the sheet 5 is stopped for a standby time period t2 shorter than t1. The sheet 5 is fed again to the printing region after the expiration of the time period t2.

Specifically, since the sheet 5 tends to create strong reverse curl as temperature and humidity become low, the above-mentioned standby time period t1 is set to be longer than that of t2 so as to earn a time period when the sheet become the forward curl state. Such a standby time period can be freely changed or neglected in accordance with the other environment condition.

Figure 13:
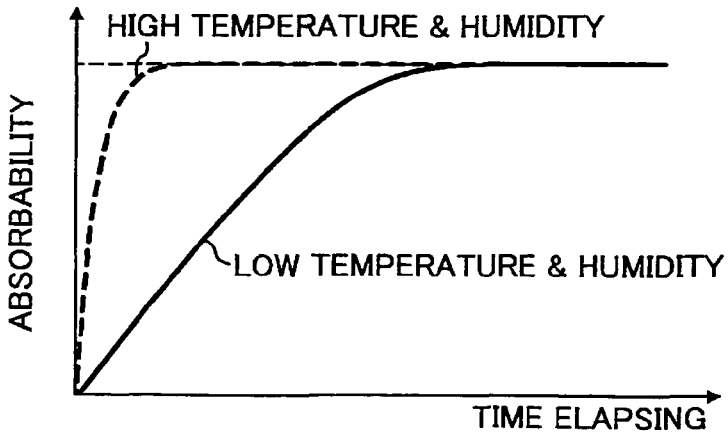
FIG. 13 illustrates an exemplary relation between environment temperature, absorption force, and time elapsing.

As shown in FIG. 13, when the environment has low temperature and humidity, the sheet 5 can be more reliably attracted and conveyed if the standby time period is increased, because a sufficient absorption force can be obtained during the time period.

Although the sheet 5 is stopped while its tip 5*a* is pinched by the tip pressure applying roller 36B and the conveyance belt 31 in the example discussed above, the same control as executed in the first, second and fourth modification can be employed. This is the same in the following embodiments.

Figure 14:
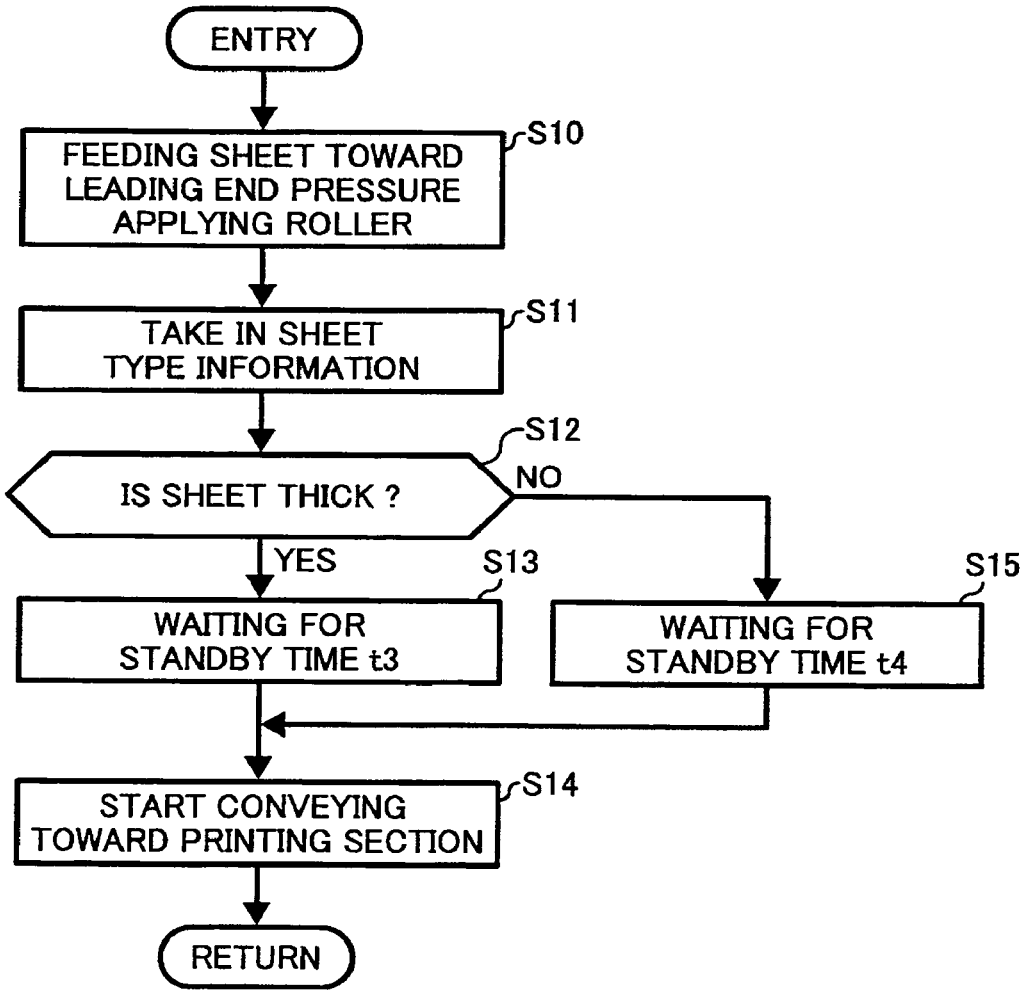
FIG. 14 illustrates still another exemplary sequence suitable for the image forming apparatus according to the third embodiment of the present disclosure.

Now, a third embodiment is described with reference to FIG. 14. Sheet feeding and conveying control is executed by the control section 300. Specifically, the sheet 5 is fed and pinched between the tip pressure applying roller 36B and the conveyance belt 31. Then, sheet type information is picked up, and it is determined whether the sheet 5 is a thick sheet. If the determination is positive (i.e., it is a thick sheet), the sheet 5 is stopped for a standby time period t3. The sheet 5 is fed again to the printing region after the expiration of the time period t3. If the determination is negative, the sheet 5 is stopped for a standby time period t4 which is shorter than t3. The sheet 5 is fed again to the printing region after the expiration of the time period t4.

Such sheet type information can be input by designation of a sheet type though an operation/display section 327 of the image forming apparatus, or by designation from a printer driver, such as an external personal computer, etc., not shown.

As a sheet, a private use sheet, such as plain paper, a thick sheet, an OHP sheet, a brilliance sheet, etc., can be exemplified. Since the thick sheet has a greater tendency to create reverse curl in comparison with plain paper, the standby time period t3 is set to be longer than t4 for the other sheet in order to provide a time period for creating forward curl. Such a standby time period can be freely changed or neglected in accordance with the type of a sheet.

Further, the second and third embodiments can be combined, and the thick sheet is used under a low temperature and humidity environment. In such a situation, a standby time period can be increased more than that for the other conditions.

Figure 15:
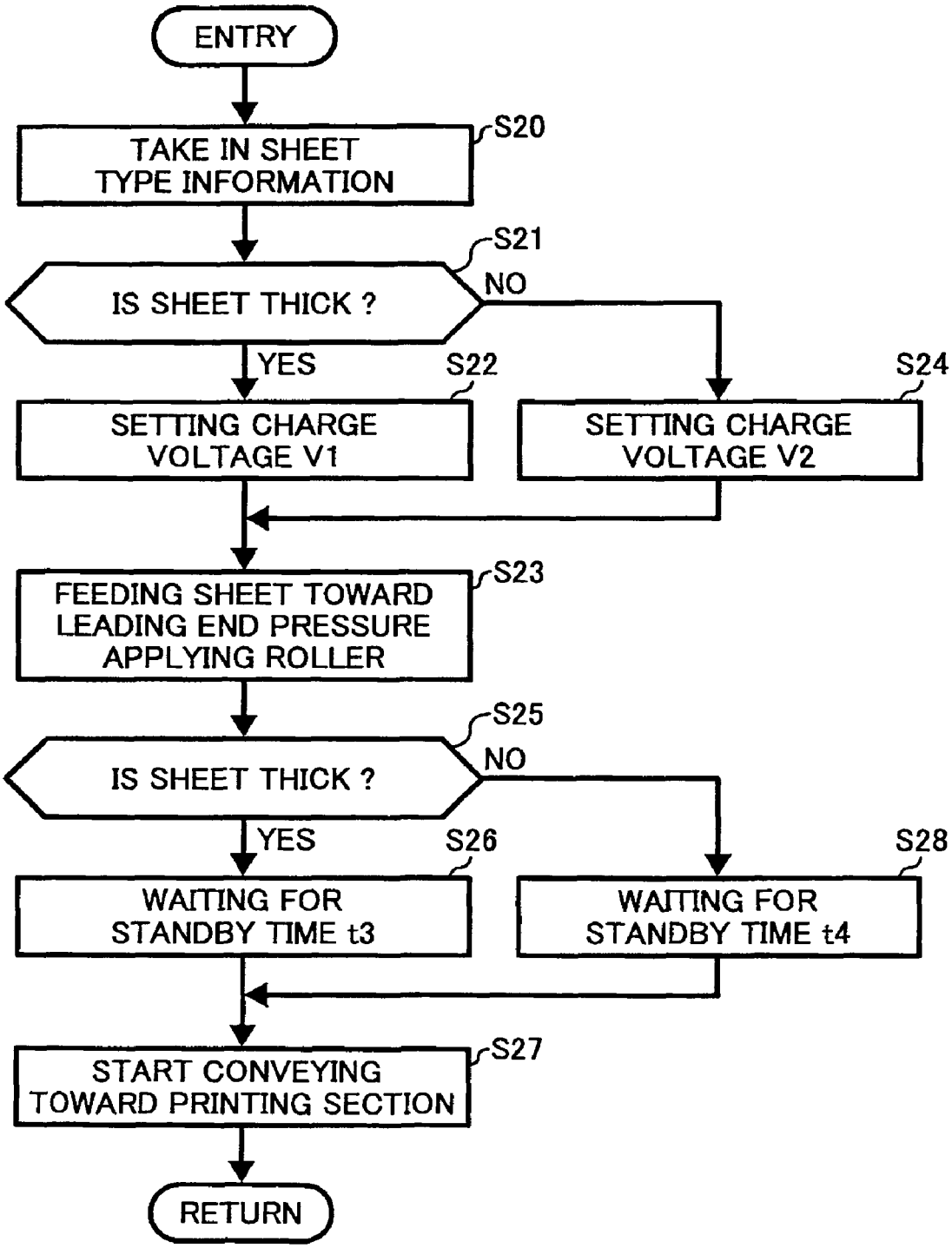
FIG. 15 illustrates still another exemplary sequence suitable for the image forming apparatus according to the fourth embodiment of the present disclosure.

Now, a fourth embodiment is described with reference to FIG. 15. Sheet feed and conveyance is controlled by the control section 300. Specifically, sheet type information is initially obtained, and it is determined if the sheet 5 belongs to a thick sheet. If the sheet 5 is thick, an AC bias voltage applied to the discharge roller 34 serving as a discharge device is set to a voltage V1 of plus or minus 2.0 kV, for example. If the sheet is not thick, the AC bias voltage is set to a voltage V2 of plus or minus 1.4.0 kV which is smaller than V1, for example.

Similar to the third embodiment, the sheet 5 is fed and pinched between the tip pressure applying roller 36B and the conveyance belt 31. Then, if the sheet is thick, the sheet 5 is stopped for the standby time period t3, and is fed again to the printing region after the expiration of the standby time period t3. If the sheet 5 is not thick, the sheet 5 is stopped for the standby time period t4 which is less than t3, and is fed again to the printing region after the expiration of the standby time period t4.

Specifically, when the sheet 5 is thick, larger electrostatic absorption force is needed than when it is plain paper. Then, the higher absolute charge voltage is used when the sheet 5 is thick than when the plain paper is used so as to increase the electrostatic absorption force and reliably forward curl on the sheet 5.

Further, the second to fourth embodiments can be combined with this embodiment, and the thick sheet is used under the low temperature and humidity environment. In such a situation, a standby time period and the discharge voltage can be increased more than those for the other conditions.

Now, another embodiment is described with reference to FIG. 16, in which a sheet 5 is linearly fed from the simplex sheet-feeding tray 141. Specifically, when a conveyance belt conveys a sheet, the conveyance belt is preferably supported and wound around at least a pair of rollers. Further, a guide member is preferably disposed inside the conveyance belt while opposing a printing region, in which a printing head is disposed, to guide the conveyance belt. Further, the upper surface of the guide member preferably protrudes from a tangential line extending between the pair of rollers toward the printing head to make a flat plane on the conveyance belt 31 opposing the printing head.

Then, in the above-mentioned image forming apparatus, the conveyance belt 31 for conveying a sheet is supported and wound around the pair of rollers 32 and 33. A guide member 35 is disposed inside the conveyance belt 31 while opposing a printing region of a printing head 24 to guide the conveyance belt. Further, the upper surface of the guide member 35 protrudes from a tangential line extending between the pair of rollers 32 and 33 toward the printing head.

Figure 16:
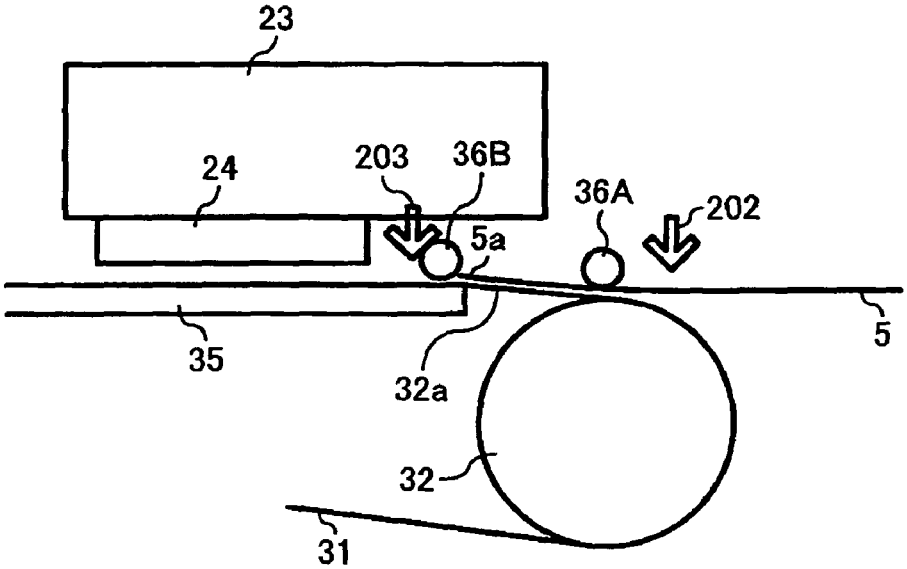
FIG. 16 illustrates an exemplary rising condition of the sheet leading section suitable for the image forming apparatus when the sheet is fed straight forward according to the fifth embodiment of the present disclosure.

As a result, a region 32*a* of the conveyance belt 31 between an outer circumferential surface of the conveyance roller 32 and the guide member 35 increasingly inclines on the downstream side as shown in FIG. 16. Thus, even when the sheet 5 is fed straight, the tip 5*a* comes to rise so that the sheet 5 creates forward curl in the inclination region 32*a* as shown in the drawing. Thus, the sheet is not reliably attracted to the conveyance belt 31 by the reason as mentioned earlier.

Figure 17:
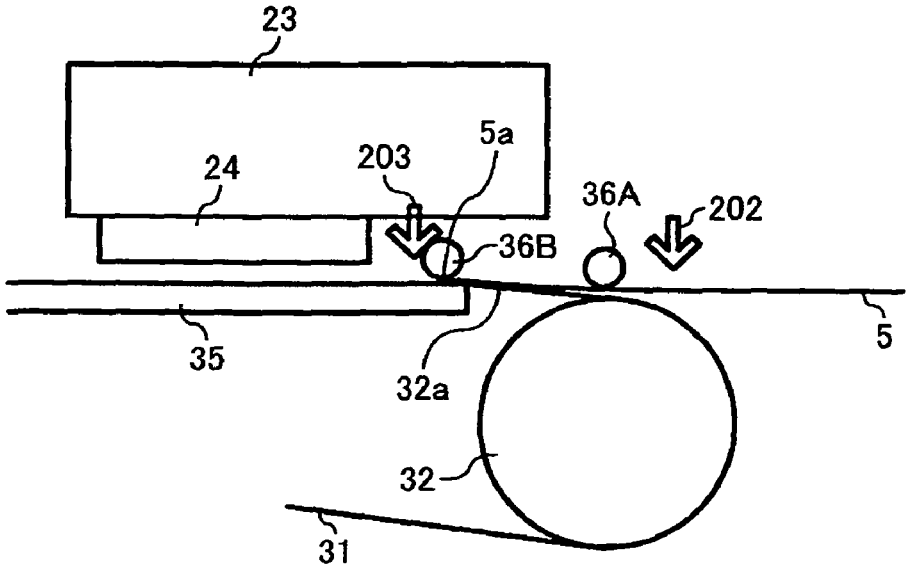
FIG. 17 illustrates an exemplary condition of the sheet when the sheet advances from the position illustrated in FIG. 16.

Then, similar to the first and fourth embodiments, the sheet 5 maintains the standby state while its tip 5*a* is pinched by the tip pressure applying roller 36B and the conveyance belt 31 as shown in FIG. 17. The sheet 5 is then fed to the printing region again after the sheet 5 has a forward curl. Thus, the above-mentioned inconvenience can be resolved by the reason as mentioned earlier. The second to fourth embodiments can be combined to this embodiment.

The present disclosure is described when applied to the multiple function printer of the image forming apparatus in the above-mentioned embodiments. However, the present disclosure can be applied to another type of an image forming apparatus, such as a printer, a facsimile, etc. Further, the present disclosure can be applied to an image forming apparatus using printing liquid other than ink. Still further, the present disclosure can be applied to another sheet conveyance device other that used in the image forming apparatus.

Obviously, numerous additional modifications and variations of the present disclosure are possible in light of the above teachings. It is therefore to be understood that within the scope of the appended claims, the present disclosure may be practiced otherwise than as specifically described herein.

This application claims priority under 35 USC §119 to Japanese Patent Application No. 2005-232940, filed on Aug. 11, 2005, the entire contents of which are herein incorporated by reference.

What is claimed is:

1. An image forming apparatus comprising:

a sheet feeding and conveying device configured to feed and convey a sheet, feeding and conveying operation of said sheet feeding and conveying device causing a curl at a tip of the sheet;

a conveyance belt configured to convey the sheet toward a printing region while attracting the sheet with electrostatic force on its flat surface, said printing region being disposed in a vicinity of the flat surface of the conveyance belt, said curl caused by the feeding and conveying operation of said sheet feeding and conveying device separating the tip of the sheet from the flat surface of the conveyance belt;

a conveyance roller configured to drive the conveyance belt and positioned upstream of the printing region;

a printing device provided in the printing region and configured to form an image on the sheet;

a leading end pressure applying roller arranged in a vicinity of the printing device, the leading end pressure applying roller being closer than the conveyance roller to the printing device and being configured to depress the sheet toward the flat surface of the conveyance belt subjected to the electrostatic force; and a controller configured to control the conveyance belt to stop conveying the sheet toward the printing region for a prescribed time period when the tip of the sheet is pinched between the leading end pressure applying roller and the conveyance belt; and an input part that inputs a sheet type designation, wherein said controller determines, based on the sheet type designation input through the input part, an amount of time the conveyance belt is to be stopped before conveying the sheet to the printing region, wherein depression force applied by the leading end pressure applying roller to the tip of the sheet for the prescribed time period in which the controller stops conveyance of the sheet by the conveyance belt when the tip of the sheet is pinched between the leading end pressure applying roller and the conveyance belt, in combination with the electrostatic force, settles down said curl at the tip of the sheet during the prescribed time period, and wherein said controller controls the conveyance belt to resume conveying the sheet toward the printing region when the prescribed time period has elapsed.

2. The image forming apparatus as claimed in claim 1, further comprising:

a sheet conveying path extending from the sheet feeding device to the conveyance belt, said sheet conveying path having a shape causing the tip of the sheet to be separated from the conveyance belt when the sheet arrives at the conveyance belt.

3. The image forming apparatus as claimed in claim 1, wherein for each of at least two sheets successively fed, a time period when said each of the at least two successively fed sheets stops on the sheet conveying path is substantially the same.

4. The image forming apparatus as claimed in claim 1, further comprising a discharge device configured to apply an electric charge to the conveyance belt to create the electrostatic force, wherein an amount of voltage applied to the discharge device is determined in accordance with a type of the sheet.

5. The image forming apparatus as claimed in claim 1, wherein said controller determines an amount of time the conveyance belt is to be stopped before conveying the sheet to the printing region in accordance with the detection result.

6. The image forming apparatus as claimed in claim 1, wherein said controller determines an amount of time the conveyance belt is to be stopped before conveying the sheet to the printing region in accordance with a type of the sheet.

7. An image forming apparatus comprising:

a sheet feeding and conveying device configured to feed and convey a sheet, feeding and conveying operation of said sheet feeding and conveying device causing a curl at a tip of the sheet;

a conveyance belt configured to convey the sheet toward a printing region while attracting the sheet with electrostatic force on its flat surface, said printing region being disposed in a vicinity of the flat surface of the conveyance belt, said curl caused by the feeding and conveying operation of said sheet feeding and conveying device separating the tip of the sheet from the flat surface of the conveyance belt;

a conveyance roller configured to drive the conveyance belt and positioned upstream of the printing region;

a printing device provided in the printing region and configured to form an image on the sheet;

a leading end pressure applying roller arranged in a vicinity of the printing device, the leading end pressure applying roller being closer than the conveyance roller to the printing device and being configured to depress the sheet toward the flat surface of the conveyance belt subjected to the electrostatic force; and a controller configured to control the conveyance belt to stop conveying the sheet toward the printing region for a prescribed time period when the tip of the sheet is pinched between the leading end pressure applying roller and the conveyance belt, wherein depression force applied by the leading end pressure applying roller to the tip of the sheet for the prescribed time period in which the controller stops conveyance of the sheet by the conveyance belt when the tip of the sheet is pinched between the leading end pressure applying roller and the conveyance belt, in combination with the electrostatic force, settles down said curl at the tip of the sheet during the prescribed time period, and wherein said controller controls the conveyance belt to resume conveying the sheet toward the printing region when the prescribed time period has elapsed, and the image forming apparatus further comprises:

a pair of registration rollers configured to execute registration of the sheet; and a guide member arranged downstream from the registration rollers and configured to guide the sheet toward the conveyance belt;

wherein said guide member depresses the tip of the sheet when the conveyance belt stops conveying.

8. The image forming apparatus as claimed in claim 1, further comprising:

a sheet conveying path extending from the sheet feeding device to the conveyance belt, said sheet conveying path having a shape causing the tip of the sheet to be separated from the conveyance belt when the sheet arrives at the conveyance belt;

wherein a time period when at least two sheets stop on the sheet conveying path is substantially the same when the at least two sheets are successively fed.

* * * * *